United States Patent [19]

Meng

[11] 4,442,710

[45] Apr. 17, 1984

[54] METHOD OF DETERMINING OPTIMUM COST-EFFECTIVE FREE FLOWING OR GAS LIFT WELL PRODUCTION

[75] Inventor: Hai-Zui Meng, Sugar Land, Tex.

[73] Assignee: Schlumberger Technology Corporation, New York, N.Y.

[21] Appl. No.: 355,115

[22] Filed: Mar. 5, 1982

[51] Int. Cl.[3] ..... E21B 49/00

[52] U.S. Cl. ..... 73/151; 73/155

[58] Field of Search ..... 73/151, 155

[56] References Cited

PUBLICATIONS

"Unsteady-State Pressure Distribution Created by a Well With a Single Infinite-Conductivity Vertical Fracture", Gringarten, Society of Petroleum Engineering Journal, Aug. 1974, pp. 347-360.

*Primary Examiner*—Howard A. Birmiel

AA T. Nind, *Principles of Oil Well Production,* Chs. 3-6 (McGraw-Hill 1964).

AB Mach, et al., "A Nodal Approach for Applying Systems Analysis to the Flowing and Artificial Lift Oil or Gas Well," SPE Paper 8025, Society of Petroleum Engineers of AIME.

AC Cinco, et al., "Transient Pressure Behavior for a Well with a Finite-Conductivity Vertical Fracture," Society of Petroleum Engineers Journal, August 1978, at 253-64.

AD Prats, "Effect of Vertical Fractures on Reservoir Behavior—Incompressible Fluid Case," Society of Petroleum Engineers Journal, June 1961, at 105-18.

AE Agarwal, et al., "Evaluation and Performance Prediction of Low-Permeability Gas Wells Stimulated by Massive Hydraulic Fracturing," Journal of Petroleum Technology, March 1979, at 362-72.

AF Vogel, "Inflow Performance Relationships for Solution-Gas Drive Wells," Journal of Petroleum Technology, January 1868, at 83-92.

AG Cullender, et al., "Practical Solution of Gas-Flow Equations for Wells and Pipelines with Large Temperature Gradients," Petroleum Transactions of AIME, Vol. 207, at 281-87 (1956).

AH Gringarten, et al., "Unsteady-State Pressure Distributions Created by a Well With a Single Infinite-Conductivity Vertical Fracture," Society of Petroleum Engineers Journal, August 1974, at 347-59.

AI Gringarten, et al., "Applied Pressure Analysis for Fractured Wells," Journal of Petroleum Technology, July 1975, at 887-91.

AJ Holditch, et al., "The Analysis of Fractured Gas Wells Using Reservoir Simulation," SPE Paper 7473, presented at the 53rd Annual Fall Technical Conference and Exhibition of the Society of Petroleum Engineers of AIME, Houston, Texas Oct. 1-3, 1978.

AK Bennett, et al., "Analysis of Pressure Data from Vertically Fractured Injection Wells," Society of Petroleum Engineers Journal, February 1981, at 5-20.

AL Guppy, et al., "Effect of Non-Darcy Flow on the Constant-Pressure Production of Fractured Wells," Society of Petroleum Engineers Journal, June 1981, at 390-400.

AM Bennett, et al., "Influence of Fractured Heterogeneity and Wing Length on the Response of Vertically Fractured Wells," SPE/DOE Paper 9886, presented at the 1981 SPE/DOE Low Permeability Symposium, Denver, Colorado, May 27–29, 1981.

AN Cinco-Ley, et al., "Transient Pressure Analysis for Fractured Wells," Journal of Petroleum Technology, September 1981, at 1749–66.

AO Al-Hussainy, et al., "The Flow of Real Gases Through Porous Media," Journal of Petroleum Technology, May 1966, at 624–36.

AP Gringarten, "Reservoir Limit Testing for Fractured Wells," SPE Paper 7452, presented at the 53rd Annual Fall Technical Conference and Exhibition of the Society of Petroleum Engineers of AIME, Houston, Texas, October 1–3, 1978.

AQ Mrosovsky, et al., "Construction of a Large Field Simulator on a Vector Computer," Journal of Petroleum Technology, December 1980, at 2253–2264.

AR Stackel, et al., "An Example Approach to Predictive Well Management in Reservoir Simulation," Journal of Petroleum Technology, June 1981, at 1087–94.

AS Bostic, et al., "Combined Analysis of Post Fracturing Performance and Pressure Buildup Data for Evaluating an MHF Gas Well," SPE Paper 8280, presented at the 54th Annual Fall Technical Conference and Exhibition of the Society of Petroleum Engineers of AIME, Las Vegas, Nevada, September 23–26, 1979.

AT Raghaven, Meng, et al., "Analysis of Pressure Buildup Data Following a Short Flow Period," SPE Paper 9290, presented at the 55th Annual Fall Technical Conference and Exhibition of the Society of Petroleum Engineers of AIME, Dallas, Texas, September 21–24, 1980.

AU Gringarten, el al., "The Use of Source and Green's Functions in Solving Unsteady-Flow Problems in Reservoirs," Society of Petroleum Engineers Journal, Oct. 1973, at 285–96.

AV R. Earlougher, Jr., *Advances in Well Test Analysis,* ch. 2 and Fig. C.13 (Mongraph Vol 5 of The Henry L. Doherty Series, Society of Petroleum Engineers of AIME, 1977).

[57] ABSTRACT

A method of determining both transient and steady state IPR curves for a well is disclosed. From these IPR curves functions can be developed which will enable the optimal cost-effective production rate for a producing well as a function of predetermined well parameters can be determined. Type curves are derived from a model of the well reservoir to provide information from which the IPR curves are determined. Production systems analysis techniques are then used to obtain families of curves at a solution point in the well production system for two different well parameters. These families of curves are analyzed to determine the points of intersection between each curve in one family of curves with each curve in the other family. From these points of intersection, a plot of a family of production rate curves versus values of a first well parameter for various values of the second parameter can be obtained. These relationships can then be analyzed to determine the most cost-effective maximum production as a function of the cost to actually obtain a value for the first parameter.

10 Claims, 16 Drawing Figures

2000
1000
0
$P_I$
(1) CONSTANT P.I.
(2) I.P.R.
$P_{wf}$ (PSI)
0
400
800
1200
1600
$q_o$ (BOPD)

600
500
400
300
200
100
0
VERTICAL AND IPR PERFORMANCE CURVE
SOLUTION POINT 3 SOLUTION
HORIZONTAL SYSTEM PERFORMANCE CURVE
900 BOPD
P (PSI)
0
500
1000
1500
$q_o$ (BOPD)

METHOD OF DETERMINING OPTIMUM COST-EFFECTIVE FREE FLOWING OR GAS LIFT WELL PRODUCTION

BACKGROUND OF THE INVENTION

This invention relates to data processing of measurements on free flowing or gas lift oil and gas wells. More particularly, this invention relates to a method which uses type curves for determining the optimum cost-effective production rate for the well as a function of the cost of obtaining particular values of various controllable well parameters, such as production tubing size, wellhead pressure, fracture half-length, gas-lift injection pressure, etc.

The testing of oil and gas wells to measure such things as the size of the fluid reservoir containing the oil and/or gas to be produced, the pressure of the fluid in the reservoir, the porosity of the formations comprising the reservoir, the temperature of the reservoir, etc., and required prerequisite steps to the quantitative determination of the steady state productivity of the well. This measured information, along with a modeling of the various elements which together characterize the well, beginning at the formation up through the production system to the point of sale of the produced oil or gas, has been used in the past to determine the productivity of the well. A commonly used prior-art method to indicate this productivity is through curves which depict the fluid pressure at any given point in the system as a function of the production flow rate past that point. When the indicated pressure is taken at the bottomhole pressure, these curves are called the inflow performance relationship IPR for the reservoir.

When the pseudo-steady state flow regime has been obtained for the well, or for that matter, the intermediate flow condition referred to as the infinite-flow regime, the prior art techniques of testing the well to obtain the IPR curves can be used. Also, simple flow equations have been developed which characterize the infinite-flow and steady state flow conditions from the reservoir. However, neight testing of the well to obtain actual pressure readings or the use of simple flow equations can be used to obtain early time or transient IPR curves for a reservoir. Testing is inadequate because of the transient nature of the IPR curve during early time. Pressure measurements would not be valid at any time other than when taken. Simple flow equations which describe the early time for a reservoir simple do not exist.

Even where simple flow equations are used to describe the performance of the reservoir for the infinite-flow and steady state flow conditions, the equations do not handle the transition period flow conditions when the flow regimes are changing.

When IPR curves for the reservoir have been obtained, it is possible using a technique commonly known in the art as the production systems analysis approach to analyze the well performance. This approach makes it possible to determine the performance of the producing system of the well at any given point in the system by dividing the system into two portions, one portion including everything from the reservoir up to a selected solution point (point of mathematical equivalence) and the other portion including everything from the solution point to the point of sale of the fluid, such as the gas sale line or the stock tank. For each of these two portions, a performance curve of the pressure versus production rate is obtained. These two curves are then plotted on a common graph where the point of intersection of the curves represents the production rate at which the well will produce.

Changes in the performance curves for these two portions of the system may be affected by varying the elements which comprise the producing system or to modify the structure of the formations of the reservoir, such as by fracturing, to effect a change in the production rate. Ideally, it is desirable to always have the point of intersection of the performance curves for the two portions of the system occur as far to the right as possible, i.e., where the production rate is greater and thus greater productivity. Much effort has been expended in the prior art trying to optimize production by moving this intersection point to the right. Such techniques as fracturing of tight formations to increase inflow performance from the reservoir to the production system, reducing the wellhead pressure by putting compressors on the well, selecting different tubing sizes and using gas lift techniques to aid in pumping oil to the surface are just a few commonly used techniques to change the overall performance curves for the components of a well to achieve this greater productivity.

These changes, however, involve an expenditure of money. For example, the cost to hydraulically fracture a tight formation to increase fluid inflow can run into millions of dollars depending on such things as how deep the fracture extends into the reservoir formations. Usually the well operator has little information to determine exactly how much fracturing is needed to obtain the maximum productivity from the well. In other words, the well operator has ways to increase productivity of his well, but has not known quantitatively how much or just what changes to make to the well that will result in the most cost-effective increase in well production.

Accordingly, it would be advantageous to provide a method of obtaining performance curves of the productivity of a well for all flow regimes of the reservoir, including the transient early time performance, as a function of a controllable parameter of the well producing system so that the maximum cost-effective production from the well can be obtained by selecting the proper value according to the expense of obtaining that value.

SUMMARY OF THE INVENTION

In accordance with the present invention, a method of determining the optimal cost-effective production rate for a producing well as a function of predetermined well parameters using type curves to characterize well behavior is disclosed. These well parameters are associated with the production of the fluid from subsurface formations forming a reservoir containing the fluid where the fluids are produced through a well production system. The well production system includes various subsystems, such as the piping for lifting the fluid to the surface, the horizontal flow tubing and a separator. The reservoir is characterized by type curves derived from a mathermatical solution to a model representing the reservoir.

The method includes the steps of obtaining measurements of physical properties of the reservoir subsurface formations, such as its temperature, and permeability. From these measured properties of the formations of the reservoir, inflow performance relationships representing the reservoir pressure response function at the well bottomhole is then determined for various values of a first well parameter, such as fracture half-length. The determination of an inflow performance relationship involves using the type curves to obtain the pressure for the reservoir as a function of the measured parameters of the reservoir. The production system pressure response function is then determined for each subsystem in the production system.

From the production system response functions at the well bottomhole a second set of functions for the fluid pressure at the well bottomhole as a function of production rate is obtained. The second set of functions is obtained by varying a second well parameter while holding all other parameters constant.

A set of production rate response functions for various values of the second parameter are then obtained where each production rate response function varies as a function of said first parameter. Each production rate response function is derived from the points of intersection between a function from the second set of functions with each function in the inflow performance relationship functions. In a final step, the production rate response functions are analyzed to determine the maximum cost-effective production rate as a function of the cost to obtain values of said first and second well parameters.

In a narrower aspect of the invention, the step of analyzing the set of production rate response functions comprises the steps of determining the value of said first parameter for a given value of said second parameter which optimizes the trade-off between the cost to obtain the value for said first well parameter and the rate of production that would result therefrom if that value were obtained.

The step of obtaining the production system response functions for the production system includes the steps of obtaining the well completion response function which characterizes the condition of the formations proximal the point of entrance to the production system from the reservoir formations. Also included is the step of determining the piping response function which characterizes the production tubing from the bottom of the well up to the surface, including any pressure restrictions within the piping which give rise to pressure losses. The determination of the surface facilities response function is also included in the determination of the production system response function where the surface facilities response function characterizes the equipment located at the surface which assist and complete the process of making the fluid available at the point of sale.

In yet another aspect of the invention, for gas wells, the step of determining an inflow performance relationship for a gas fractured well is disclosed where a set of functions of the inflow pressure versus production rate for various values of time are obtained to obtain a set of transient inflow performance relationships. These transient inflow performance relationships enable a predication of the initial production rate for the well for various values of a well parameter.

BRIEF DESCRIPTION OF THE DRAWINGS

For a fuller understanding of the invention, reference should be had to the following detailed description of the preferred embodiment taken in connection with the accompanying drawings in which.

Similar reference numerals refer to similar parts throughout the several views of the drawings.

DETAILED DESCRIPTION OF THE PREFERRED EMBODIMENT

Figure 1:
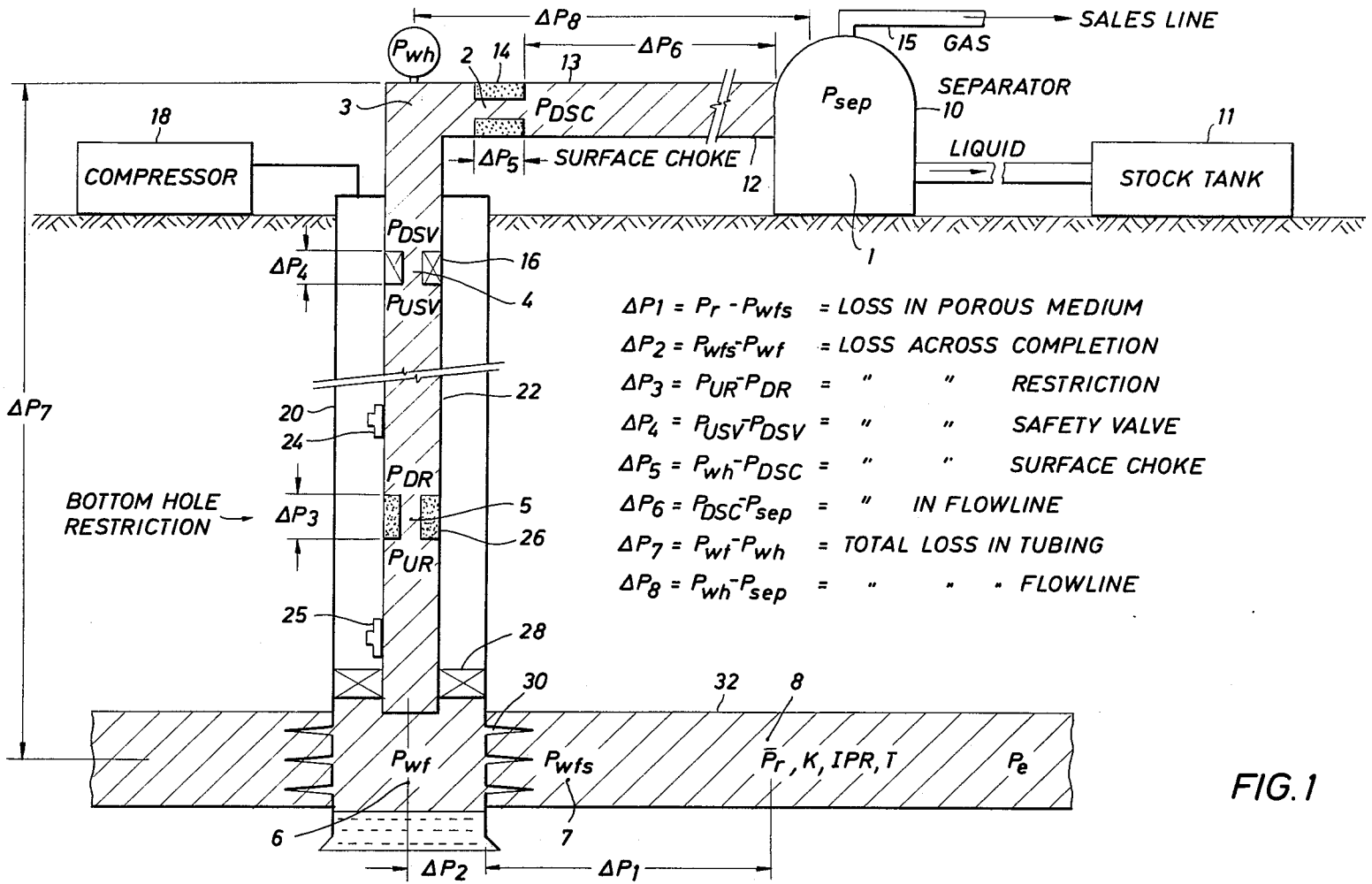
FIG. 1 is a pictorial representation of a typical producing well showing the pressure drops from the formation to the point of sale of the produced fluid.

Referring to the figures and first to FIG. 1, a pictorial representation of the various components of a typical free flowing or gas lift well is shown. A formation reservoir 32 contains the oil and/or gas to be produced. Certain parameters of the reservoir are of interest, such as the average reservoir pressure $\overline{P}_r$, the permeability of the formation k, the inflow performance relationship which describes the pressure versus flow rate into the production system and the temperature T of the reservoir. The well casing 20 is shown perforated with perforation tunnels 30 to permit the inflow of the fluid from the reservoir 32 into the wellbore.

The production tubing 22 transmits the fluid to the surface where the pressure at the wellhead is determined. Located on the surface are the surface facilities, such as the horizontal piping 13 which connects the wellhead to the separator 10. The separator 10 separates the gas from the oil and presents the gas to the sales line 15 and the liquid product to the stock tank 11. Stock tank 11 and the sales line 15 represent the point of sale for the fluids produced from the well.

FIG. 1 shows that the production system contains internal elements which produce pressure losses within the production system, for example, surface choke 14, safety valve 16 and bottom hole restriction 26. Where gas lift techniques are to be used to help raise the fluid to the surface, a compressor 18 is used to pressurize the annulus of the casing 20 down to the packer 28. Injection valves 24, 25 are shown attached to the production tubing 22. The pressurized lift gas within the annulus of the casing 20 is allowed to enter the production tubing 22 through the injection valves. The lift gas creates a higher gas-to-liquid ratio to facilitate flow to the surface. Also shown in FIG. 1 are the various pressure drops which can occur for the system illustrated.

It is well known in the art to use systems analysis to analyze well performance. See, for example, the book by T. Nind, "Principles of Oil Well Production", chapters 3 and 4, McGraw-Hill Book Company, 1964. In addition to the systems analysis presented by Professor Nind, a further systems analysis procedure, presented in the article by Mach, et al., entitled "A Nodal Approach For Applying Systems Analysis To The Flowing And Artificial Lift Oil Or Gas Wells," paper SPE 8025 of the Society of Petroleum Engineers, has gained wide acceptance in the industry as a proper way to design and evaluate both flowing and gas-lift wells. This procedure evaluates a producing system by breaking it down into three basic components, flow through the porous formations, flow through the production tubing and flow through the surface facilities including the horizontal flow lines (see FIG. 1). The vertical piping 22 including any safety valves, chokes, etc., plus the surface facilities including the horizontal flow line, the separator, and the well completion comprise the production system for purposes of applying the Mach, et al. production systems analysis to determine the well performance.

To predict system performance, the pressure drop in each component or subsystem of the production system is obtained. The procedure for obtaining the pressure drops involves selecting solution points at various locations in the system. FIG. 1 illustrates solution points with reference numerals 1–8, that are distributed throughout the production system and the reservoir. Suitable mathematical or physical models are used to predict the pressure drop between any two solution points for various flow rates. The mathematical or physical models sometimes referred to as "correlations" are well known in the art for determining these pressure drops. Once a solution point is selected, these drops are added or subtracted to the starting point pressure until the solution point is reached.

To use the Mach, et al. production systems analysis concept, the pressure at the starting point, at least, must be known. In a producing system, two pressures are known and assumed to be fairly constant. These are the separator pressure, $P_{sep}$, and the average reservoir pressure, $\overline{P}_r$. Therefore, calculations of the pressure drops must begin with either $P_{sep}$ or $\overline{P}_r$, or both if an intermediate solution point is selected.

Figure 2:
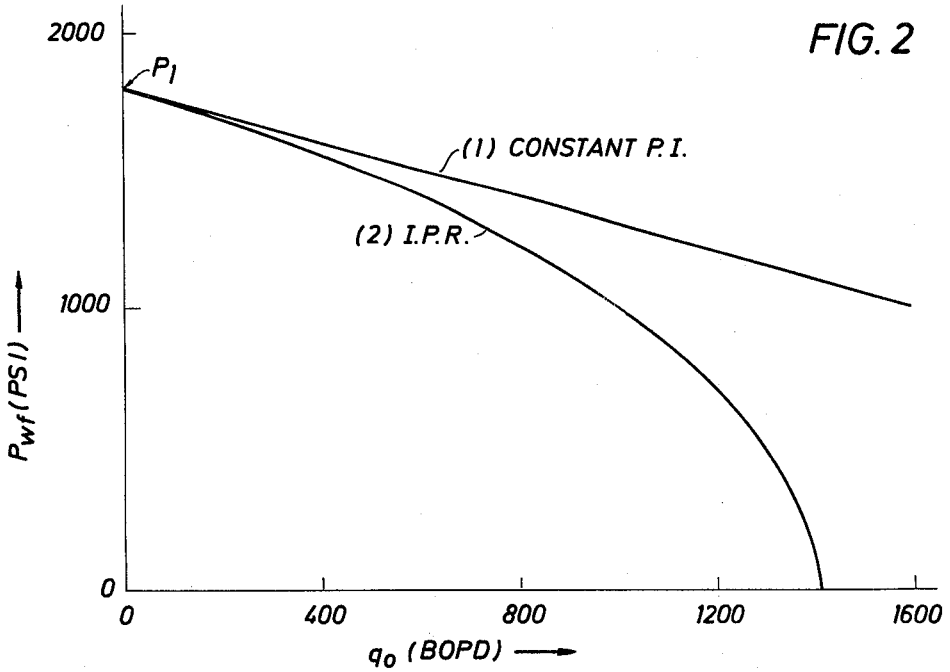
FIG. 2 is a plot of a typical inflow performance relationship of the wellbore flowing pressure as a function of the production rate.

Referring now to FIG. 2, a plot of a typical inflow performance relationship IPR in the form of a plot of the flowing bottomhole pressure $P_{wf}$ as a function of the oil production rate $q_o$ is shown ($q_g$ would represent the gas production rate). Two IPR curves are shown, one for a constant productivity index PI and the other for a typical IPR curve where the pressure decreases non-linearly with increase in production rate. Both curves began at the initial average reservoir pressure $\overline{P}_r$.

Figure 3:
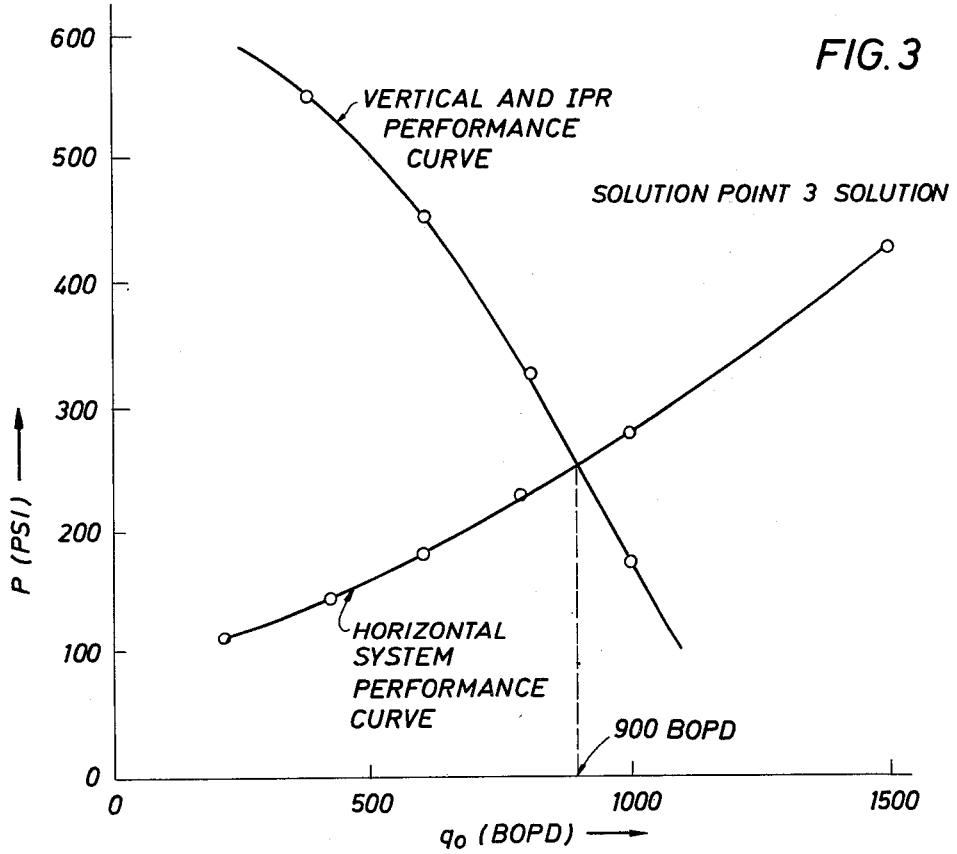
FIG. 3 is a plot of the production systems analysis analysis for a typical oil producing well.

Turning now to FIG. 3, a solution using the Mach, et al. production systems analysis approach for the production rate for solution point 3, the wellhead, of the well shown in FIG. 1 is illustrated. The curve labeled "vertical and IPR performance curve" was obtained by starting with the average reservoir pressure $\overline{P}_r$ and subtracting the pressure drops in the reservoir and the vertical tubing string 22 up to the solution point 3. The curve labeled "horizontal system performance curve" was obtained by starting with the pressure at the separator $P_{sep}$ and adding the pressure drop in the horizontal flow line from the separator 10 to the solution point 3.

The point of intersection of the two curves shown in FIG. 3 represents the production rate which would be obtained for the given well parameters which produced the two curves. For this particular example, 900 barrels per day of oil would be expected with a flowing wellhead pressure of about 250 psi given certain well data. The evaluation of the producing system can be made very complex by adding pressure drops across surface chokes, safety valves, bottom hole chokes, completion techniques such as gravel-pack, fracturing, etc. However, the methodology remains the same, with only the mathematical or physical models to determine the pressure drops varying according to the particular situation with regard to the presence or absence of the internal pressure losses and the particular type of completion used to complete the well.

Figure 4A:
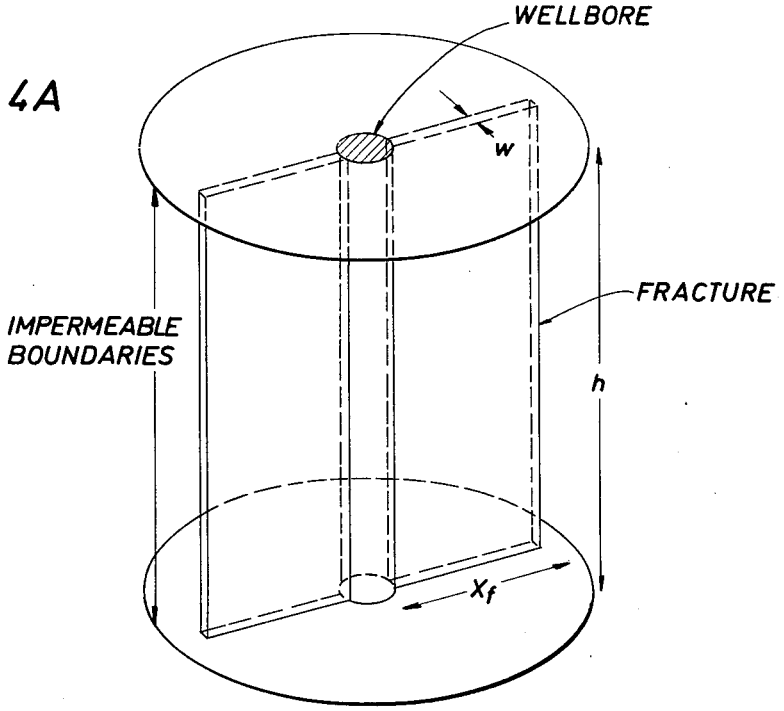
FIG. 4A is a pictorial representation of a finite-conductivity vertical fracture in an infinite slab reservoir.

In this regard, the present invention can be best understood with reference to the following description of the production system analysis of a vertically fractured well, such as the one illustrated in FIG. 4A. FIG. 4A illustrates a finite-conductivity vertical fracture in an infinite slab reservoir where the fracture has a width W and a height h and a fracture half-length $x_f$ measured from the center of the well bore to the outer extent of the fracture. A mathematical and physical model of this fracture is given in the article by Cinco, et al., entitled "Transient Pressure Behavior for a Well With a Finite-Conductivity Vertical Fracture," appearing in the Society of Petroleum Engineers Journal, August 1978, pages 253–264.

The hydraulic fracturing of tight formations or low permeability reservoirs has been recognized to be an effective means for improving well productivity. A large amount of energy and effort has been given to the determination of the transient pressure behavior of a well intercepted by a vertical fracture. See, for example, the articles "Effect of Vertical Fractures on Reservoir Behavior-Incompressible Fluid Case," appearing in the Society of Petroleum Engineers Journal, June 1961, at pages 105–118, by M. Prats, and the article "Evaluation and Performance Prediction of Low-Permeability Gas Wells Stimulated by Massive Hydraulic Fracturing," Journal of Petroleum Technology, March 1979, at pages 362–372, authored by Agarwal, et al. The contributions of these efforts have provided the practicing engineer with a better understanding of the fractured reservoir performance.

In 1968, J. V. Vogel, in his article "Inflow Performance Relationships for Solution-Gas Drive Wells," appearing in the Journal of Petroleum Technology, January 1968, at pages 83–92, presented a correlation to generate inflow performance relationship IPR curves for solution-gas drive wells based on the assumption of steady-state Darcy's law. The application of IPR curves in the analysis of total production systems is well recognized in the art. For example, see the previously cited work of Professor Nind and the article by Mach. Recently, exploitation of low-permeability or tight gas reservoirs has required more advanced well stimulation techniques, such as massive hydraulic fracturing MHF. Unfortunately, pseudo-steady state pressure behavior for a tight gas reservoir is rarely seen in the early production life of the wells, and heretofore, the transient IPR curves for wells intercepted by finite-conductivity vertical fractures have not been possible.

In other words, early time analysis of the pressure response of the reservoir as a function of production rate has not been available. Since psuedo-steady state pressure behavior in a tight gas reservoir is not seen in the early life of the well, standard prior art techniques of testing a well to develop measurements of the IPR curve are not possible. Additionally, simple flow equations which characterize the pressure versus production rate for an infinite acting reservoir (middle life of a well) or steady state conditions can only be used when the well flow regimes are in correspondence with the equations. However, no sample flow equations are available for characterizing the early time for the well. Further, the pressure response of the well when it is in the transition phases of changing from early life to infinite acting or from infinite acting into steady state are not handled by the simple flow equation approach. The equations simple do not characterize the pressure response of the reservoir at these transition times.

In order to illustrate the present invention, "type curves" for a vertically fractured gas well were derived from a mathematical model of a fractured gas reservoir. While application to type curves for a fractured gas well is disclosed, the methodology of the present invention could be used to apply to type curves for any reservoir which can be modeled and a solution obtained.

Type curves give dimensionless pressure versus dimensionless time profiles for various values of a parameter, such as dimensionless formation conductivity. These curves represent a mathematical solution which is valid for all time for the reservoir, and can be used to develop the transient IPR curves for a well. Type curves are known in the art. For example, type curves are presented in the Cinco article identified above. Unfortunately, the curves of Cinco's model do not extend backward into time far enough to obtain information from which transient IPR curves can be produced. The earliest time that an IPR curve could be produced from the Cinco type curves for a typical fractured well is approximately 60 days. The minimum dimensionless time on Cinco's type curves is $10^{-3}$. To predict well production during early dimensionless time requires type curves back to $10^{-5}$, and the mathematical solution to Cinco's model of the reservoir cannot be used to extend this time scale backwards.

To obtain type curves for the reservoir usable to illustrate the invention, a different model for the fractured formation gas reservoir was developed and a new solution derived which would produce type curves for the early life of the reservoir.

To derive type curves usable to produce transient IPR curves from which the most cost-effective production can be obtained, the model for the reservoir is characterized by the partial differential equations which characterize flow through the reservoir with proper initial and boundary conditions. The following assumptions concerning flow behaviors are made: First, the reservoir is considered to be horizontal, infinite in extent, isotropic, homogeneous, porous medium bounded by upper and lower impermeable strata with permeability, k, and uniform thickness, h. The reservoir is initially at constant pressure, $P_i$, and completely filled with a constant viscosity, $\mu$, slightly compressible fluid of compressibility c.

Second, the well is intercepted by a finite-conductivity symmetrical vertical fracture which penetrates the entire vertical extent of the formation. The fracture has a permeability, $k_f$, half-length, $x_f$, width, W, porosity, $\phi_f$, total compressibility, $c_{tf}$ (see FIG. 4). Third, the well is located at the center of an infinite reservoir and is producing at constant rate, q. The flow entering the wellbore comes only through the fracture and is considered to obey Darcy's law in the entire system. Wellbore storage and skin effects are not considered in this derivation. Finally, gravitational effects and pressure gradients are assumed to be negligible and the properties of both the reservoir and fracture are considered independent of pressure.

The physical system with the above assumptions is shown in FIG. 4A. The semi-analytical model developed in this study is similar to the model used in the Cinco article, but contains several differences. These differences may be characterized as follows: First, the derivation according to the present invention uses the linear flow equation based on Darcy's law to describe the flow entering the wellbore via the fracture only. Second, the dimensionless wellbore pressure drop, $P_{wD}$, is obtained directly by treating it as an unknown variable. A detailed mathematical formulation and method of solution is given below where the general solutions are presented in terms of dimensionless variables defined as follows, first for oil and then for gas:

Dimensionless wellbore pressure drop $$P_{wD} = \frac{kh(P_i - P_{wf})}{141.2\, qB\mu} \tag{1}$$

$$m_{wD} = \frac{kh(m(P_i) - m(P_{wf}))}{1424.qT} \tag{2}$$

where k is the reservoir permeability, $P_i$ is the initial reservoir pressure, $P_{wf}$ is the flowing bottomhole pressure, q is the flow rate, B is the formation volume factor, $\mu$ is the viscosity of the fluid, $m_{wD}$ is the dimensionless well pseudo-pressure, $m(P_i)$ is the pseudo-pressure evaluated at $P_i$, and $m(P_{wf})$ is the pseudo-pressure evaluated at $P_{wf}$;

Dimensionless pressure loss through the fracture $$P_{Df} = \frac{kh(P_f - P_{wf})}{141.2\, qB\mu} \tag{3}$$

$$m_{Df} = \frac{kh(m(P_f) - m(P_{wf}))}{1424.qT}, \tag{4}$$

where $P_f$ is the pressure at the tip of the fracture;

Dimensionless time $$t_{Dxf} = \frac{0.000264.kt}{\phi\mu c_t x_f^2} \quad (5)$$

$$t_{Dxf} = \frac{0.000264.kt}{\phi(\mu c_t)i\, x_f^2}, \quad (6)$$

where t is time, $\phi$ is formation porosity, and $c_t$ is system total compressibility; and Dimensionless fracture conductivity $$F_{cD} = \frac{k_f w}{k\, x_f} \quad (7)$$

where $k_f$ is the fracture permeability.

For convenience, the model was developed based on liquid flow cases, however, it can be extended to real gas flow cases by using the real gas pseudo-pressure function presented in an article entitled "The Flow of Real Gases Through Porous Media," authored by Al-Hussainy, et al., appearing in the Journal of Petroleum Technology, May 1966, at pages 624–636.

Figure 4B:
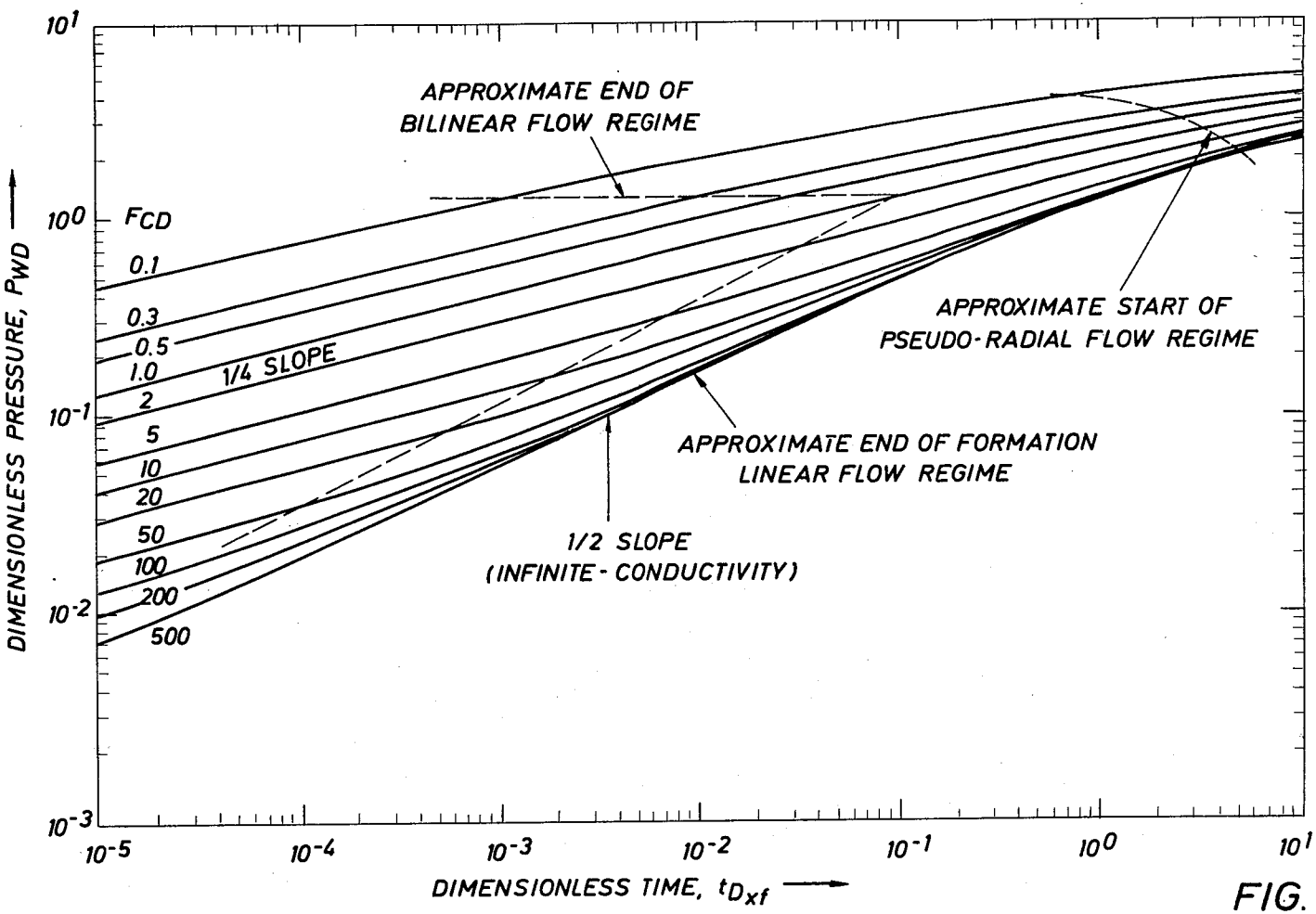
FIG. 4B is an illustration of "type curves" for a finite-conductivity vertically fractured gas well obtained to illustrate the present invention.

Cinco showed that dimensionless pressure drop is a function of dimensionless time, $t_{Dxf}$, and dimensionless fracture conductivity, $F_{cD}$, for practical values of dimensionless time. FIG. 4B is an illustration of the type curves generated based on the model developed according to the present invention. As shown in FIG. 4B, the time range of Cinco's type curves have been extended to earlier time. In the present invention, a type curve with wide range of dimensionless time, $t_{Dxf}=10^{-5}$ to $t_{Dxf}=10$ is presented.

Three flow regimes have been identified. First, a bilinear flow regime which is indicated by a well-defined one-fourth slope straight line for $F_{cD} \leqq 50$ which can be observed only at early time. Second, a formation linear flow regime which is indicated by a one-half slope straight line can be observed only for high fracture conductivity.

This illustrates that the solution for a finite-conductivity model with high fracture conductivity ($F_{cD} \geqq 500$) yields similar results to those of the infinite-conductivity model. Third, a pseudo-radial flow regime can be observed at late time for values of $F_{cD} \geqq 0.1$.

To formulate the flow model for the fractured system, two flow regions are considered, the reservoir and the fracture. For convenience, the following derivations are based on the liquid flow cases.

For flow in the reservoir, the transient flow behavior in the reservoir can be described by considering the fracture as a plane source, of height, h, length, $2x_f$, and flux density $q_f(x,t)$. The dimensionless pressure drop at any point in the reservoir, obtained by applying the Green and source functions and Newman product method is given by:

$$p_D(x_D, y_D, t_{Dxf}) = \frac{1}{4}\int_0^{t_{Dxf}} \int_{-1}^{1} \frac{q_D(x_D',\tau)}{(t_{Dxf}-\tau)}\, e^{-\frac{(x_D-x_D')^2+y_D^2}{4(t_{Dxf}-\tau)}}\, dx_D'\, d\tau, \quad (8)$$

$$\text{where } p_D(x_D, y_D, t_{Dxf}) = \frac{kh[p_i - p(x,y,t)]}{141.2\, qB\mu}$$

-continued $$t_{Dxf} = \frac{0.000264kt}{\phi\mu ct\, x_f^2}$$

$$x_D = \frac{x}{x_f} \qquad y_D = \frac{y}{x_f} \text{ and}$$

$$q_D(x_D',\tau) = \frac{2\, q_f(x_D',\tau)\, x_f}{q}. \quad (9)$$

If the dimensionless pressure drop along the fracture, $Y_D=0$, then equation (8) can be written as:

$$p_D(x_D, 0, t_{Dxf}) = \frac{1}{4}\int_0^{t_{Dxf}} \int_{-1}^{1} \frac{q_D(x_D',\tau)}{(t_{Dxf}-\tau)}\, e^{-\frac{(x_D-x_D')^2}{4(t_{Dxf}-\tau)}}\, dx_D'\, d\tau. \quad (10)$$

For flow in the fracture, the fracture is considered as a finite slab, homogeneous-porous medium of height, h, length, $2x_f$, and width, W. Fluid enters the fracture at a rate $q_f(x,t)$ per unit of fracture length and joins other fluid flowing within the fracture from other parts of the fracture. Flow across the fracture tip is assumed negligible. The well is produced at a constant rate, q, and fluid flowing within the fracture is considered to obey Darcy's law. The equation describing the flow of fluid within the fracture is given in dimensionless form as:

$$-\frac{\partial p_{fD}}{\partial x_D} = \frac{2\pi}{F_{cD}}\, q_{fD}(x_D, t_{Dxf}), \quad (11)$$

$$\text{where } p_{fD} = \frac{kh[p_i - p_f(x,t)]}{141.2\, qB\mu}$$

$$F_{cD} = \frac{k_f w}{k\, x_f} \quad \text{and} \quad q_{fD} = \frac{2q_f(x,t)}{q}\, x_f.$$

Integrating equation (11) from wellbore to any point in the fracture gives $$-\int_0^{p_{fD}(x_D, t_{Dxf})} dp_{fD} = p_{fD}(0, t_{Dxf}) - p_{fD}(x_D, t_{Dxf}) = \frac{2\pi}{F_{cD}} \int_0^{x_D} q_{fD}(x_D', t_{Dxf})\, dx_D'. \quad (12)$$

Equation (12) describes the dimensionless pressure drop along the fracture.

To obtain a complete solution requires solving equations (10) and (12) simultaneously. This requires satisfying the continuity of both pressure drop at any point in the fracture and the flux density in the fracture between two flow models as given by the following expression:

$$[p_D(0,0,t_{Dxf}) - p_D(x_D,0,t_{Dxf})]_{reservoir} = [p_{fD}(0,t_{Dxf}) - p_{fD}(x_D, t_{Dxf})]_{fracture}, \text{ and} \quad (13)$$

$$[q_D(x_D, t_{Dxf})]_{reservoir} = [q_{fD}(x_D, t_{Dxf})]_{fracture}. \quad (14)$$

A combination of equations (10), (12), (13), (14) gives:

$$p_{wD} - \frac{1}{4}\int_0^{t_{Dxf}} \int_{-1}^{1} \frac{q_D(x_D',\tau)}{(t_{Dxf}-\tau)}\, e^{-\frac{(x_D-x_D')^2}{4(t_{Dxf}-\tau)}}\, dx_D'\, d\tau = \quad (15)$$

-continued $$\frac{2\pi}{F_{cD}} \int_0^{x_D} q_D(x_D', t_{Dxf}) dx_D'.$$

Figure 14:
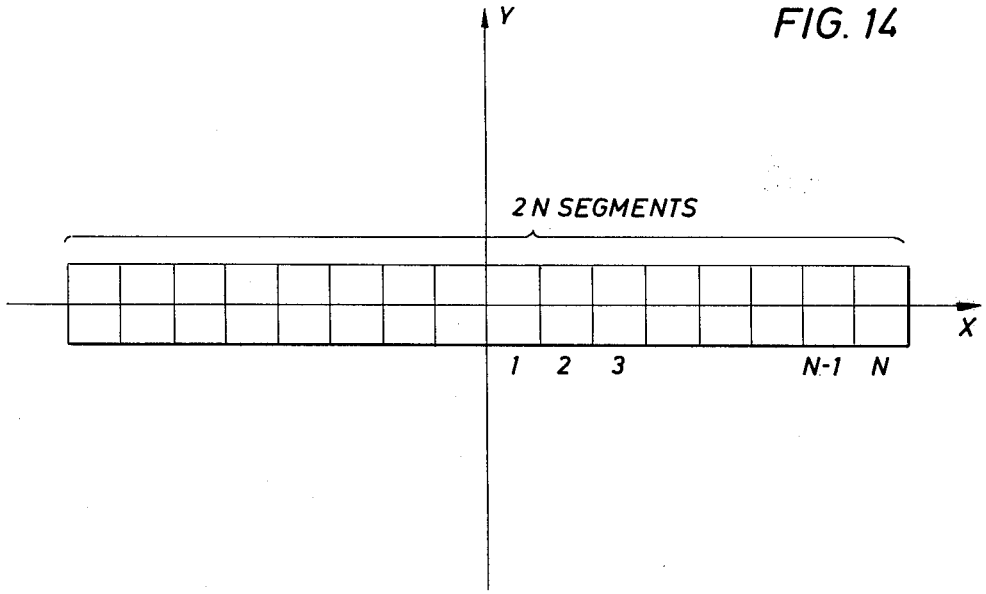
FIG. 14 is a diagram showing the division of the fracture shown in FIG. 4A into 2N segments.

Equation (15) can be solved by discretization in time and space so that the fracture is divided into 2N equal segments (see FIG. 14) and time is divided into k different intervals. It is also assumed that flux density has a stepwise distribution in time and space. Formulating equation (15) in discretizing form gives $$P_{wD} - \frac{\sqrt{\pi}}{4} \sum_{l=1}^{k} \sum_{i=1}^{N} \frac{2(q_{Dl} - q_{Dl+1})}{\Delta x} \{x_{i,j}^{k,l-1} - x_{i,j}^{k,l} + Y_{i,j}^{k,l-1} - Y_{i,j}^{k,l}\} = \frac{2\pi}{F_{cD}} \left\{ \left[ \sum_{i=1}^{j-1} \left( q_{Di}^{k} \cdot \frac{\Delta x}{2} + q_{Di+1}^{k} \cdot \frac{\Delta x}{2} \right) \right] + q_{Dj}^{k} \cdot \frac{3\Delta x}{8} + q_{Dj+1}^{k} \cdot \frac{\Delta x}{8} \right\} \quad (16)$$

for each fracture segment $1 \geqq j \geqq n$ at time level k where $$x_{i,j}^{k,l} = 2\sqrt{\Delta t_{k,l}} \left\{ \operatorname{erf}\left[\frac{\alpha_{i,j}}{\sqrt{\Delta t_{k,l}}}\right] - \operatorname{erf}\left[\frac{\beta_{i,j}}{\sqrt{\Delta t_{k,l}}}\right] + \operatorname{erf}\left[\frac{\gamma_{i,j}}{\sqrt{\Delta t_{k,l}}}\right] - \operatorname{erf}\left[\frac{\delta_{i,j}}{\sqrt{\Delta t_{k,l}}}\right] \right\} \text{ and}$$

$$Y_{i,j}^{k,l} = -\frac{2}{\sqrt{\pi}} \left\{ \alpha_{i,j} E_i \left[ -\frac{\alpha_{i,j}^2}{\Delta t_{k,l}} \right] - \beta_{i,j} \cdot E_i \left[ -\frac{\beta_{i,j}^2}{\Delta t_{k,l}} \right] + \gamma_{i,j} \cdot E_i \left[ -\frac{\gamma_{i,j}^2}{\Delta t_{k,l}} \right] - \delta_{i,j} E_i \left[ -\frac{\delta_{i,j}^2}{\Delta t_{k,l}} \right] \right\}$$

$$\Delta t_{l,l-1} = (t_{Dxf})_l - (t_{Dxf})_{l-1}$$

$$\alpha_{i,j} = \frac{j - i + \frac{1}{2}}{2N} \qquad \Delta x = \frac{1}{N}$$

$$\beta_{i,j} = \frac{j - i - \frac{1}{2}}{2N}$$

$$\gamma_{i,j} = \frac{j + i - \frac{1}{2}}{2N}$$

$$\delta_{i,j} = \frac{j + i - \frac{3}{2}}{2N}$$

For details on equation (16), see the Cinco article.

Figure 15:
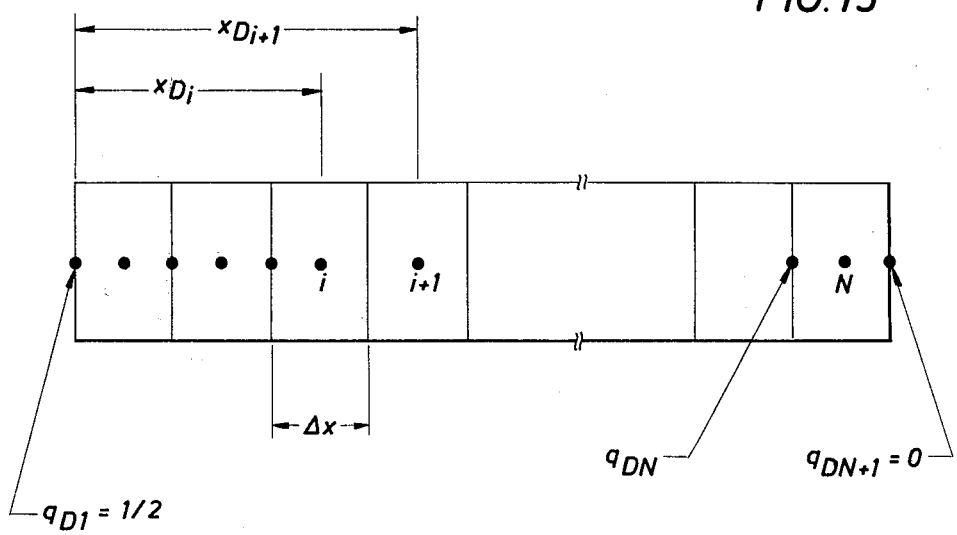
FIG. 15 is a pictorial representation of the grid locations for N segments along the fracture.

FIG. 15 shows the grid location for N segments along the fracture since only half of the fracture is being considered because of symmetry. Note that dimensionless wellbore pressure drop, $P_{wD}$, is introduced as an unknown variable. Also $q_{D1}^{l}$ is always equal to $\frac{1}{2}$ for the rate at the wellbore and $q_{DN+1}^{l}$ is always equal to zero for no flow entering at the tip of the fracture.

Equation (16) contains N linear system of equations with N unknown and can be solved by Gaussian elimination procedure. The matrix problem involved can be written as $$Mx = b \quad (17)$$

where $$x = [q_{D2}, q_{D3}, \ldots q_{DN}, P_{wD}]T$$

is the unknown vector needed to be solved.

Once the $q_{Di}^{k}|_{i=2}^{N}$ and $P_{wD}$ have been solved from equation (17), then dimensionless pressure loss through the fracture can be obtained by numerical integration of the equation $$P_{Df}(t_{Dxf}, F_{cD}) = \frac{2\pi}{F_{cD}} \int_0^1 q_D(x_D', t_{Dxf}) dx_D'. \quad (18)$$

Massive hydraulic fracturing, as well as normal fracturing, is quite expensive and has presented production engineers with several problems. For example, how can an engineer design a fracture job for a tight gas well to achieve the optimal fracture half-length, tubing and surface facility sizes so that the most cost-effective production can be obtained. The method of the present invention generates information to allow production engineers to make a cost effective judgment according to production rate versus one of the controllable well parameters, such as the fracture half-length.

In accordance with the present invention, the "type curves" derived above are used to predict well performance for all time ranges, including both transient and steady state flow conditions. Reservoir performance IPR curves for different fracture characteristics. The sensitivity of the tubing capacity performance under different conditions is also investigated. Finally, the tubing capacity performance is combined with the reservoir performance to predict production rate versus a well parameter, such as fracture half-length relationships, to enable the production engineer to analyze his system to select the most cost-effective setting for the well parameter to achieve the maximum production rate.

Figure 5:
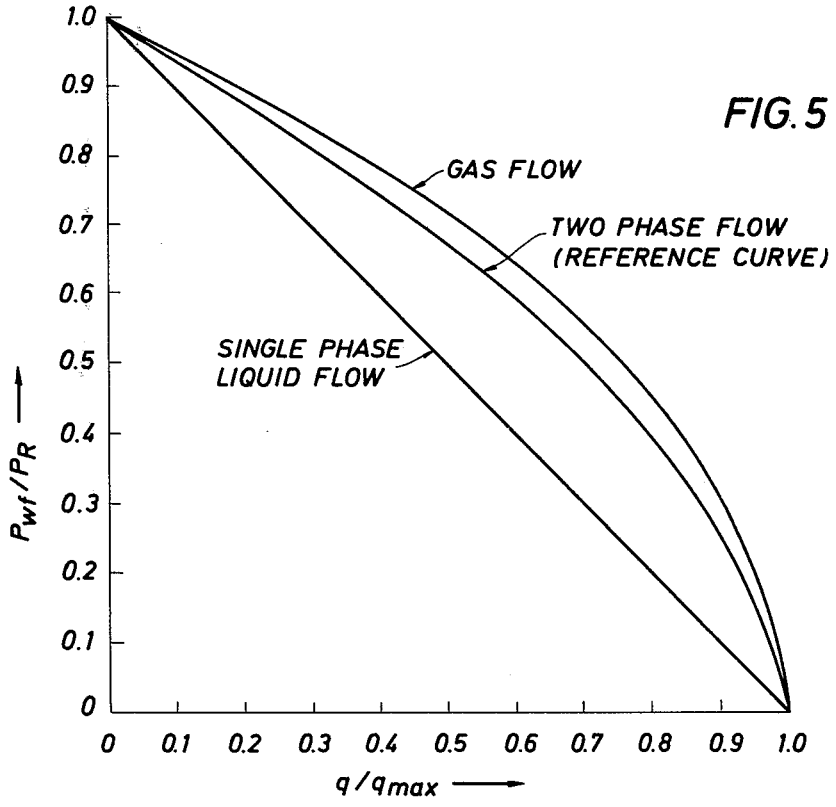
FIG. 5 is a plot of the comparison of the dimensionless inflow performance relationships for liquid flow, gas flow and two-phase liquid flow.

The inflow performance of a well, a relationship of flowing bottom-hole pressure versus the production rate, represents the ability of that well to produce fluids. As previously discussed, a typical plot for an IPR curve is shown in FIG. 2. In the Vogel article, a correlation to generate IPR curves for solution-gas drive wells is presented. Vogel proposed a reference curve based on a Cartesian plot of $P_{wf}/\overline{P}_r$ versus $q/q_{max}$. FIG. 5 illustrates the dimensionless IPR curves for three cases: single phase liquid flow, single phase gas flow and two-phase flow. As seen in FIG. 5, a straight line relationship holds for single phase liquid flow, only. The IPR curves for the gas wells, as well as solution-gas wells, exhibit non-linearities or curvature.

It would be most advantageous to develop an IPR curve that is also linear for gas wells to illustrate the present invention, such a straight line IPR curve for gas wells has been developed. Beginning with the suggestion presented in the Al-Hussainy article, an equation representing a straight line relationship can be derived as follows:

For any gas well, the pseudo-pressure function of flowing bottomhole pressure at any given time $m(P_{wf}(t))$ can be obtained according to the following equation:

$$m(P_{wf}(t)) = m(P_i) - C_1(t)q_g(t), \tag{19}$$

where $m(P_i)$ is the initial pseudo-pressure of the reservoir, $q_g(t)$ is the gas production rate, and $C_1(t)$ is a constant which depends upon time and system parameters independent of pressure and production rate. The expression for $C_1(t)$ can be found in the book by Earlougher entitled "Advances in Well Test Analysis," chapter 2, page 13 as published by SPE volume 5.

Similarly, the equation for average pseudo-pressure of the reservoir at any given time $\bar{P}_r(t)$ is given by:

$$m(\bar{P}_r(t)) = m(P_i) - C_2(t)q_g(t) \tag{20}$$

where $C_2(t)$ is also a constant which depends only on time and system parameters.

Subtracting equation (20) from equation (21) yields;

$$m(\bar{P}_R(t)) - m(P_{wf}(t)) = (C_1(t) - C_2(t))q_g(t). \tag{21}$$

If $P_{wf}(t)=O$, the maximum production rate $q_{gmax}(t)$ results. Thus, equation (21) becomes $$q_{gmax}(t) = \frac{m(\bar{P}_R(t))}{C_1(t) - C_2(t)}. \tag{22}$$

Using the following identity, $$1 - \frac{m(P_{wf}(t)}{m(\bar{P}_r(t))} = \frac{m(\bar{P}_r(t)) - m(P_{wf}(t))}{m(\bar{P}_r(t))}. \tag{23}$$

and substituting equations (20) and (21) into equation (23), yields the following equation:

$$1 - \frac{m(P_{wf}(t))}{m(\bar{P}_r(t))} = \frac{q_g(t)}{m(\bar{P}_r(t))/(C_1(t) - C_2(t))} \tag{24}$$

From equations (22) and (24), the following straight line relationship is obtained:

$$\frac{q_g(t)}{q_{gmax}(t)} = 1 - \frac{m(P_{wf}(t))}{m(\bar{P}_r(t))}. \tag{25}$$

Equation (25) holds true throughout the entire production life of any gas well, unfractured or fractured. The advantage of normalizing dimensionless variables in terms of pseudo-pressure functions is that more simple procedures can be followed for reservoir performance prediction purposes. In other words, the simple procedure for generating transient IPR curves for a well intercepted by finite conductivity fracture can be developed. For example, it is known that the pseudo-pressure of the flowing wellbore $m(P_{wf}(t))$ can be obtained by the following expression:

$$m(P_{wf}(t)) = m(P_i(t)) - \frac{m_{wD}(t_{Dxf}, F_{cD}) \cdot 1424 q_g(t) \cdot T}{kh}, \tag{26}$$

where $m_{wD}(t_{Dxf}, F_{cD})$ represents a dimensionless pseudo-pressure drop as a function of dimensionless time and dimensionless fracture conductivity and $m(P_i(t))$ is the initial pseudo-pressure of the reservoir. A value for this variable is obtained from the type curves as presented in FIG. 4B. The parameter T is the reservoir temperature.

The average pseudo-pressure of the reservoir as a function of time $m(\bar{P}_r(t))$ can be obtained from the following expression:

$$m(\bar{P}_r(t)) = m(P_i(t)) - \frac{\bar{m}_D(t_{Dxf}, F_{cD}) \cdot 1424 q_g(t) \cdot T}{kh}, \tag{27}$$

where $\bar{m}_D(t_{Dxf})$ is the dimensionless average pressure drop and can be obtained through material balance calculations.

Next, an expression for the maximum rate of production for the gas as a function of time $q_{gmax}(t)$ can be obtained by solving equation (25). Using the maximum rate of production for the gas as a function of time and the average pseudo-pressure of the reservoir determined above, a relationship between the rate of production of the gas as a function of the pseudo-pressure of the following wellbore $m(P_{wf}(t))$ can be obtained by solving equation (25).

Figure 6:
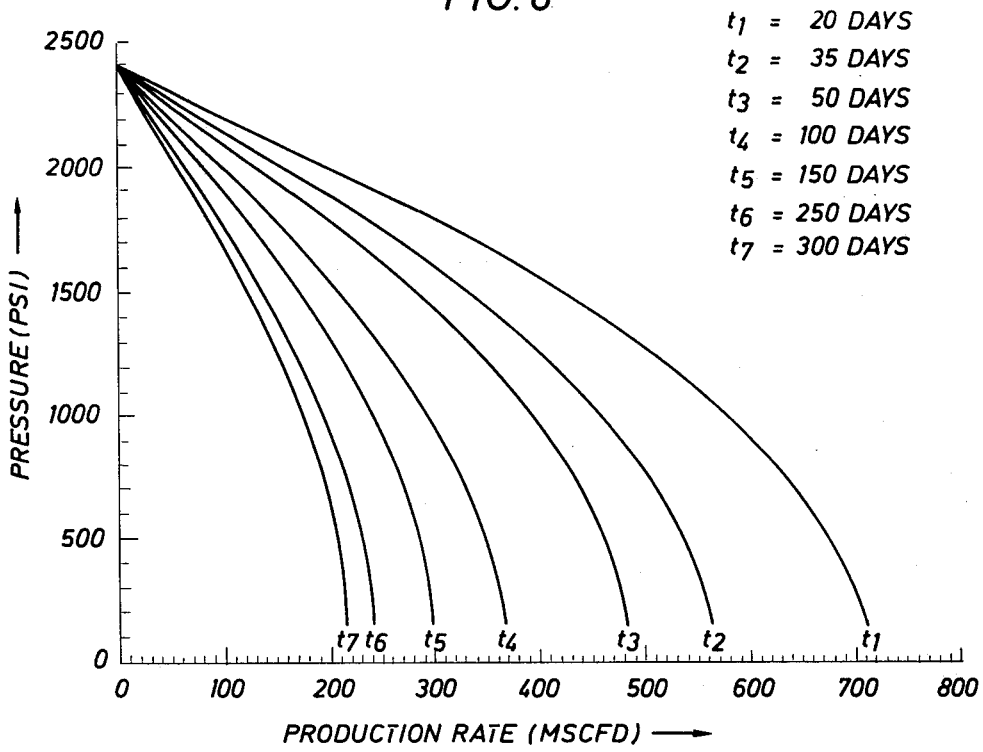
FIG. 6 is a plot of transient inflow performance relationship curves for a well intersecting a finite conductivity vertical fracture.

Finally, an IPR curve of $P_{wf}(t)$ as a function of the production rate $q_g(t)$ can be constructed by converting the pseudo-pressures to true pressures. FIG. 6 is a plot of the transient IPR curves generated by the solutions to the equations given above. The reservoir data for calculating the curves as shown in FIG. 6 are listed in TABLE 1.

TABLE 1

MHF GAS WELL TEST DATA

| Reservoir Data | |
|---|---|
| Reservoir pressure, $P_i$, psi | 2394 |
| Reservoir temperature, T, °R | 720 |
| Formation thickness, h, ft | 32 |
| Reservoir permeability, k, md | 0.0081 |
| Formation porosity, $\phi$, fraction PV | 0.107 |
| Total system compressibility, $c_t$, psi$^{-1}$ | $2.34 \times 10^{-4}$ |
| Initial gas viscosity, $\mu_i$, cp | 0.0176 |
| Flowing bottomhole pressure, $p_{wf}$, psi | 400 |
| Fracture half-length, $x_f$, ft | 727 |
| Fracture flow capacity, $k_f w$, md-ft | 294 |

Referring once again to FIG. 1, the producing system used for oil and gas well production consists of three phases, flow through the reservoir, flow through vertical or directional conduits, and flow through the horizontal pipes. As previously discussed, to study the complete system, two procedures should be followed: First, analyze each portion of the system separately and combine all parts of the system using the Mach, et al. production systems analysis technique to the analyze of the system. For simplicity, the following discussion considers reservoir and unrestricted tubing capacity performance only. There are no internal pressure restrictions within the production system, although the analysis techniques presented herein can be applied to more complicated production systems, such as that shown in FIG. 1.

It is well known in the art that the use of steadystate single phase or multi-phase flow correlations in predicting the pressure drop along the vertical conduit 22 or horizontal flow line 13 as shown in FIG. 1 is appropriate in most reservoir simulation studies. For the present invention, the correlations presented in the article entitled "Practice Solution of Gas-Flow Equations for Well and Pipelines with Large Tempeature Gradients," authored by Cullender, et al., appearing in the Transactions of the AIME, 1956, Vol. 207 at pages 281–287 was used to generate the tubing intake curves for vertical or inclined gas flow.

Figure 7:
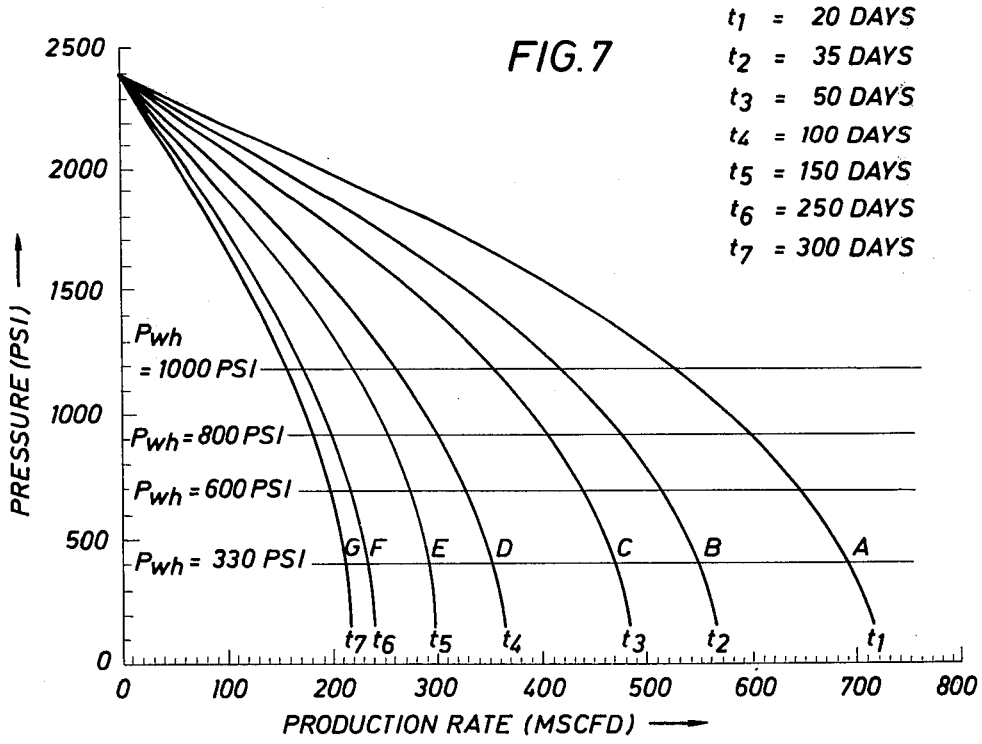
FIG. 7 is a plot of the transient IPR curves shown in FIG. 6 intersected with the tubing capacity curves at various wellhead pressures for a fixed value of fracture half-length.

Referring now to FIG. 7, a plot of both the transient IPR curves with a finite-conductivity vertically fractured well and the tubing capacity curves as developed from the correlations identified above is shown. The intersections of the transient IPR curves and tubing capacity curves represents the producing capability of the well at a given time for a particular set of system parameters, such as wellhead pressure, tubing size, and fracture characteristics. TABLE 1 above and TABLE 2 below show the parameters used to obtain the curves of FIG. 7. The solution point for the curves of FIG. 7 was selected as the bottomhole point 6 (see FIG. 1).

TABLE 2

DATA USED TO GENERATE TUBING CAPACITY CURVE

| | |
|---|---|
| Tubing size, in. I.D. | 1.995 |
| Vertical depth, ft | 8000 |
| Bottomhole temperature, °F. | 260 |
| Specific gravity of gas (Air = 1) | .65 |
| Variable wellhead pressure (psi) | |
| $P_{wh}(1)$ | 330 |
| $P_{wh}(2)$ | 600 |
| $P_{wh}(3)$ | 800 |
| $P_{wh}(4)$ | 1000 |

Figure 8:
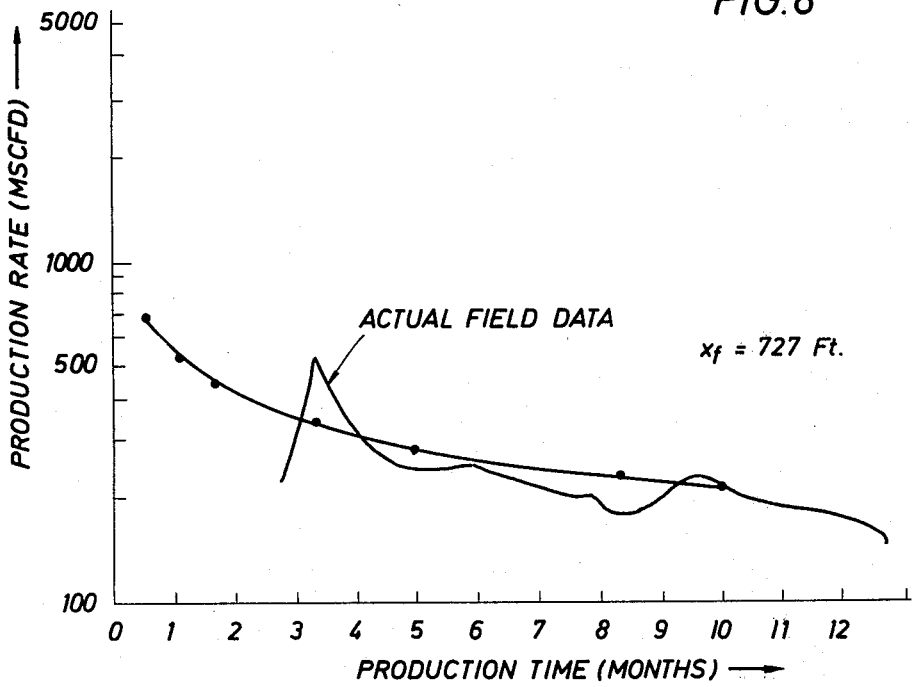
FIG. 8 is a plot of the production rate versus production time for the initial startup of a typical well.

Referring now to FIGS. 7 and 8, a comparison of the predicted results according to the present invention and the actual results for the well of TABLES 1 and 2 for an actual MHF producing gas well is shown. The predicted curve shown in FIG. 8 is generated from the intersections of the curves shown in FIG. 7 and labeled points A, B, C, D, E, F and G. For the curves of FIG. 7, the fracture half-length $x_f$ is equal to 727 feet.

Figure 9:
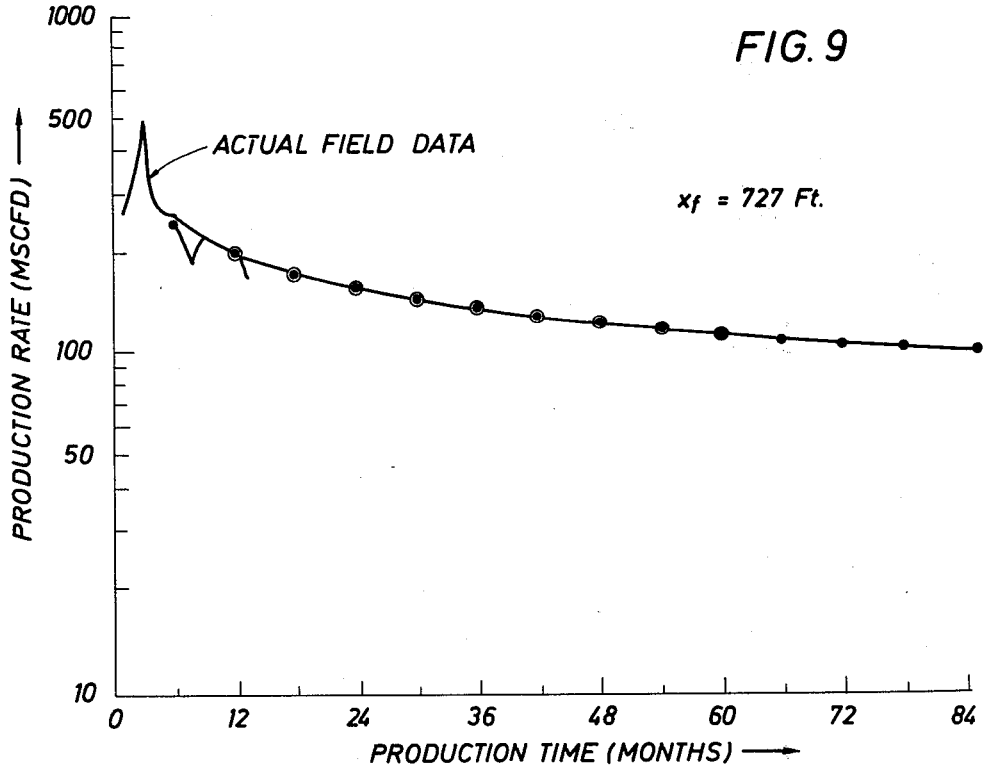
FIG. 9 is a long-term plot of the production rate versus producing time for the fractured gas well shown in FIG. 8.

Referring now to FIG. 9, a more expanded time scale for the production rate versus time is shown. During the initial production from a well, the production rate will vary significantly, especially due to initial fracturing of the well. With time, these variations will cease and approach the production curve as shown in FIG. 9. Using the techniques according to the present invention, it would then be possible to predict the production rate versus time for various values of fracture half-length so that the optional cost-effective production over time for a given well can be determined according to the fracture half-length and its cost to obtain.

In the case of fractured gas wells, it would be especially advantageous to obtain quantitative information about the production rate versus the fracture half-length for different tubing and surface facility constraints. In this manner, the operator will be able to make decisions which will produce the most cost-effective production rate from his well, such as trading off the cost of obtaining a particular fracture half-length versus the resultant production. To obtain the production rate as a function of fracture half-length, the IPR curves for the well at a given production time for a set of fracture design characteristics must be obtained. These IPR curves could easily be obtained using the linear gas flow reference curve as described above.

Figure 10:
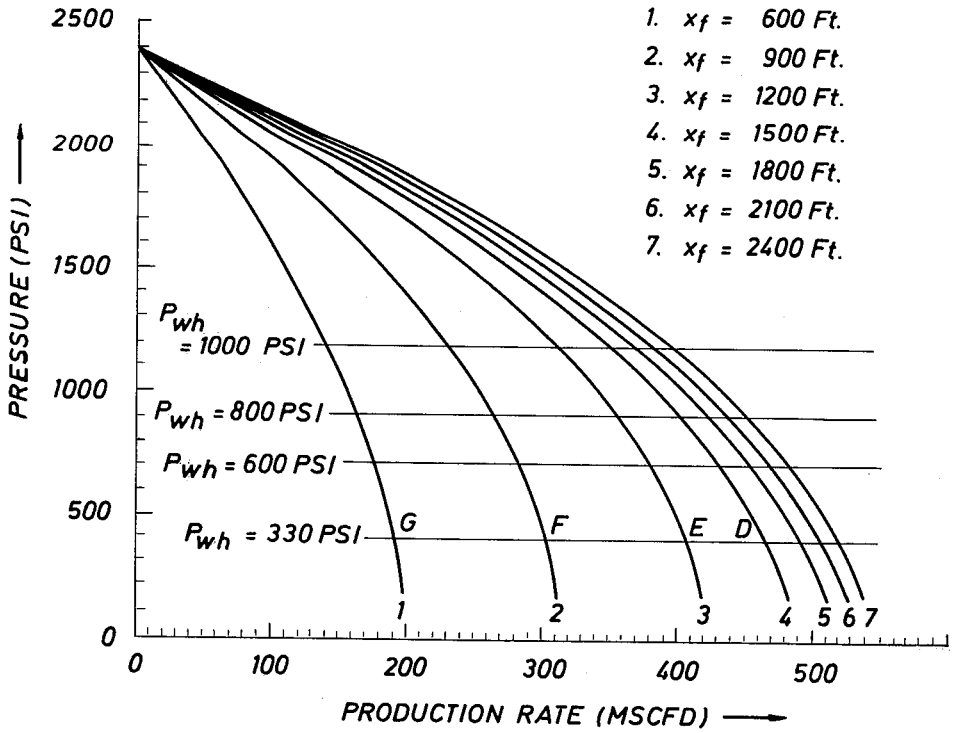
FIG. 10 is a plot of the transient IPR curves for different values of fracture half-length intersected with the tubing capacity curves at various wellhead pressures at a fixed time.
Figure 11:
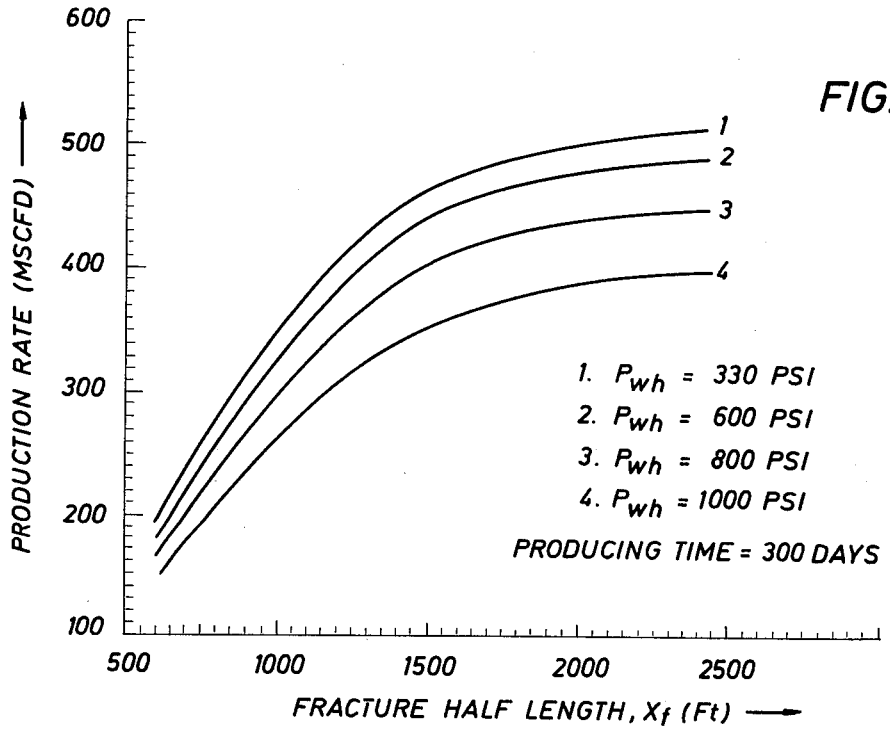
FIG. 11 is a sensitivity analysis plot of the production rate versus the fracture half-length for various values of wellhead pressure as obtained from FIG. 10.

FIG. 10 illustrates the IPR curves for the well whose parameters are given in TABLES 1–2, where each curve shown in FIG. 10 is for a different fracture half-length. Also shown in FIG. 10 are the tubing capacity curves developed for a particular tubing size and wellhead pressure. From the points of intersection, points A, B, C, D, E, F and G, of a given tubing capacity with the IPR curves results in the curve 1 illustrated in FIG. 11. FIG. 11 is a plot of the production rate versus fracture half-length for varius values of tubing capacity, all taken at a production time equal to 300 days for the well of tables 1–2.

It can be seen from FIG. 11 that the production rate does not linearly increase with fracture design half-length, and that production system parameters, such as the wellhead pressure and the tubing size, are important factors on the ultimate well performance. Because of the non-linearity of the increase in production rate with fracture half-length, it becomes evident that greater and greater fracturing does not yield greater and greater production. There is a point of diminishing returns when considering the cost to obtain a particular fracture half-length against the resulting production. Thus, the curves of FIG. 11 enable the operator to select which fracture half-length he wants to spend money to obtain versus the rate of production that he will achieve as a result.

Figure 12:
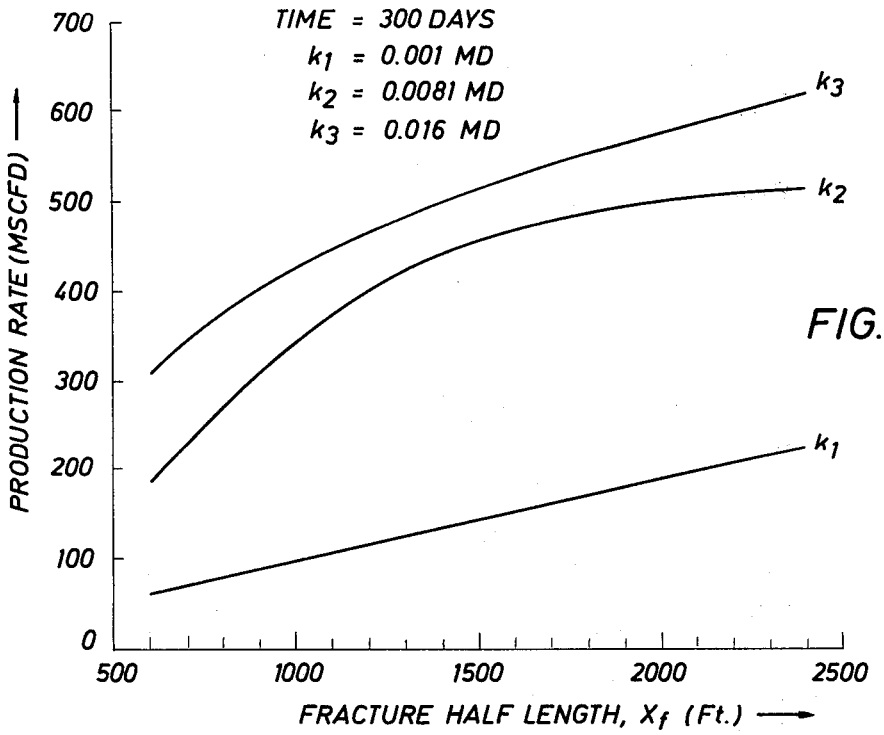
FIG. 12 is a sensitivity analysis plot of the production rate versus the fracture half length for various values of permeability of the formation for the same well as shown in FIG. 11.
Figure 13:
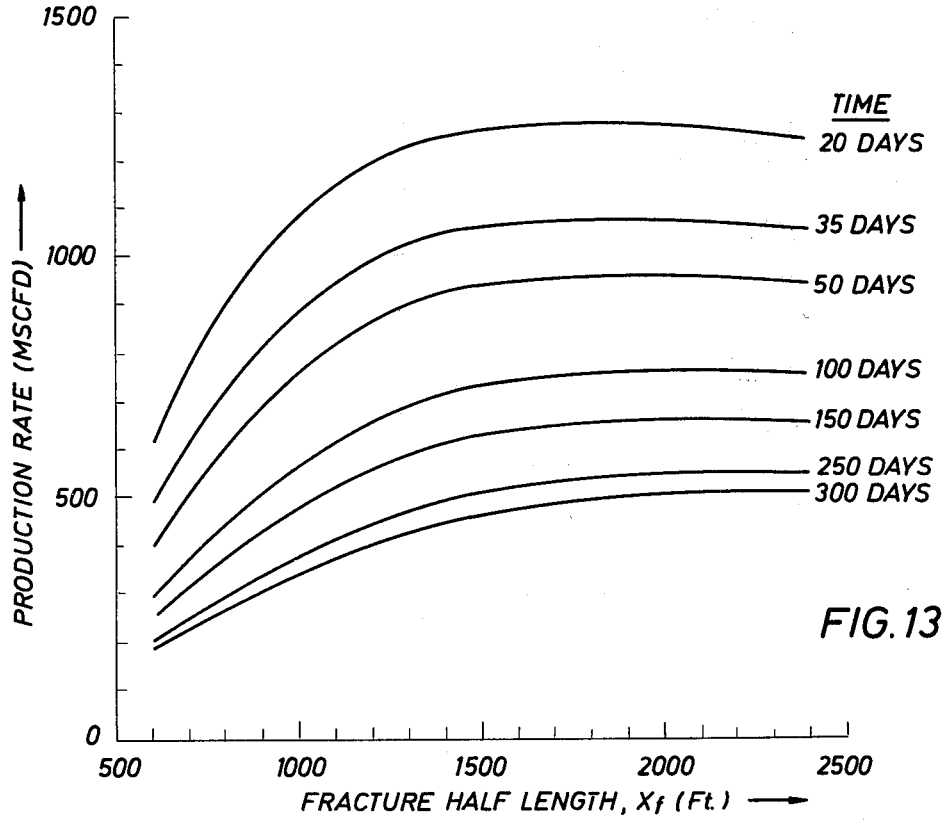
FIG. 13 is a sensitivity analysis plot of the production rate versus the fracture half-length for various times from initial startup for the gas fractured well as shown in FIG. 10.

FIGS. 12 and 13 illustrate different sensitivity analysis curves of the production rate versus fracture half-length for various system parameters, such as the permeability of the reservoir (FIG. 12) or production rate under transient conditions (FIG. 13). FIG. 12 illustrates that a good estimate of the reservoir permeability is an important parameter and should be obtained from a prepressure transient test. From FIG. 13, it is evident that the larger fracture treatment may not contribute the most on the ultimate well performance over the life of the well. Once the optimal fracture design length and production system parameters have been determined, the future well deliverability can be predicted (FIG. 9).

While the present invention has been described in connection with a finite-conductivity vertically fractured gas well, the invention is equally applicable to all types of flowing or gas-lift wells including production from an oil well.

In describing the invention, reference has been made to an example which illustrates a preferred embodiment of the method of the invention. However, those skilled in the art and familiar with the disclosure of the invention may recognize additions, deletions, substitutions or other modifications which would fall within the purview of the invention as defined in the appended claims.

What is claimed is:

1. A method of determining the optimal cost-effective steady state production rate for a producing well as a function of predetermined well parameters associated with the production of a fluid from subsurface formations forming a reservoir containing the fluid, the fluid produced through a well production system having subsystems thereof and where the reservoir pressure performance is characterized by type curves, the method comprising the steps of:

(a) obtaining measurements of physical properties of the reservoir;

(b) determining reservoir pressure response functions as a function of production rate for various values of a first well parameter, each pressure response function in the form of well bottomhole inflow performance relationships developed from the measurements of the physical properties of the reservoir and the use of the type curves derived from a mathematical solution to a model representing the reservoir;

(c) obtaining the production system pressure response function for each subsystem in the production system;

(d) obtaining from production system responses a second set of functions for the fluid pressure at the well bottomhole as a function of production rate, said second set of functions obtained by varying a second well parameter while holding all other parameters constant;

(e) obtaining a set of production rate response functions for various values of said second parameter where each production rate response function varies as a function of said first parameter; and (f) analyzing said set of production rate response functions to determine the maximum cost-effective production rate as a function of the cost to obtain values of said first and second well parameters.

2. A method of claim 1 wherein each production rate response function is derived from the points of intersection between a function from said second set of functions with each function in said inflow performance relationship functions.

3. A method of claim 1 wherein the step of analyzing the set of production rate response functions comprises the step of determining the value of said first parameter for a given value of said second parameter which optimizes the trade-off between the cost to obtain the value for said second well parameter and the rate of production that would result therefrom.

4. The method of claim 1 wherein the step of obtaining the production system response functions for the production system includes the step of obtaining, (a) the well completion response function which characterizes the condition of the formations proximal the point of entrance to the production system from the reservoir formations, (b) the piping response function which characterizes the production tubing from the bottom of the well up to the surface, including any pressure restrictions within the piping which give rise to pressure losses, and (c) the surface facilities response function which characterizes the equipment located at the surface to assist and complete the process of making the fluid available at the point of sale.

5. The method of claim 1 wherein the fluid is a gas to be produced from a fracture zone in the subsurface formations in the reservoir, the fracture zone having a fracture half-length $x_f$, and wherein the step of determining an inflow performance relationships for the gas fractured well includes the steps of:

(a) determining the wellbore flowing pseudo-pressure $m(P_{wf}(t))$ according to the following relationship, $$m(P_{wf}(t)) = m(P_i(t)) - \frac{m_{wD}(t_{Dxf}, F_{cD}) \cdot 1424 \cdot q_g(t) \cdot T}{kh},$$

where $m(P_i(t))$ is the initial reservoir pseudo-pressure, $m_{wD}(t_{Dxf}, F_{cD})$ is the dimensionless pseudo-pressure drop obtained from the type curves of the reservoir at the dimensionless time $t_{Dxf}$ given by the expression, $$t_{Dxf} = \frac{0.000264 \cdot kt}{\phi(\mu C_t)_i x_f^2}$$

where t is time,
$\phi$ is the formation porosity,
$C_t$ is the system total compressibility,
$\mu$ is the viscosity of the gas,
$q_g(t)$ is the gas production rate as a function of time,
T is the reservoir temperature,
k is the reservoir permeability, and
h is the height of the fracture zone in the reservoir formations;

(b) determining the average reservoir pseudo-pressure $m(\bar{P}_r(t))$ according to the following relationship, $$m(\bar{P}_r(t)) = m(P_i(t)) - \frac{\bar{m}_D(t_{Dxf}) \cdot 1424 \cdot q_g(t) \cdot T}{kh},$$

where $\bar{m}_D(t_{DXf})$ is the dimensionless average pseudo-pressure drop;

(c) determining the maximum flow rate $q_{gmax}(t)$ for the gas according to the following relationship, $$q_{gmax}(t) = (1 - m(P_{wf}(t))/m(\bar{P}_r(t))/q_g(t);$$

and (d) determining the IPR curve of $p_{wf}(t)$ as a function of $q_g(t)$ by solving the following relationship for $m(P_{wf}(t))$, $$m(P_{wf}(t)) = m(\bar{P}_r(t))(1 - q_g(t)/q_{gmax}(t)),$$

where $m(\bar{P}_r(t))$ and $q_{gmax}(t)$ are the results of steps (b) and (c) above, and then convering from psuedo-pressure to actual pressure,.

6. A method of determining the early time production rate for a producing well as a function of time where the fluid is produced from subsurface formations forming a reservoir containing the fluid, the fluid produced through a well production system having subsystems thereof and where the reservoir pressure performance is characterized by type curves, the method comprising the steps of:

(a) obtaining measurements of physical properties of the reservoir;

(b) determining reservoir pressure response functions as a function of production rate for various values of time, each pressure response function in the form of the well bottomhole inflow performance relationship developed from the measurements of the physical properties of the reservoir and the use of the type curves derived from a mathematical solution to a model representing the reservoir;

(c) obtaining the production system pressure response function for each subsystem in the production system;

(d) obtaining from the production system responses a second set of functions for the fluid pressure at the well bottomhole as a function of production rate, said second set of functions obtained by varying a second well parameter while holding all other parameters constant; and (e) obtaining a set of production rate response functions for various values of said second parameter where each production rate response function varies as a function of time thereby to obtain a set of transient inflow performance relationships; and (f) analyzing said set of production rate response functions to determine the maximum cost-effective early time production as a function of the cost to obtain values of said second well parameter.

7. A method of claim 6 wherein each production rate response function is derived from the points of intersection between a function from said second set of functions with each function in said inflow performance relationship functions.

8. A method of claim 6 wherein the step of analyzing the set of production rate response functions comprises the step of determining the value of said second parameter which optimizes the trade-off between the cost to obtain the value for said second well parameter and the rate of early time production that would result therefrom.

9. The method of claim 6 wherein the step of obtaining the production system response functions for the production system includes the step of obtaining, (a) the well completion response function which characterizes the condition of the formations proximal the point of entrance to the production system from the reservoir formations, (b) the piping response function which characterizes the production tubing from the bottom of the well up to the surface, including any pressure restrictions within the piping which give rise to pressure losses, and (c) the surface facilities response function which characterizes the equipment located at the surface to assist and complete the process of making the fluid available at the point of sale.

10. The method of claim 6 wherein the fluid is a gas to be produced from a fracture zone in the subsurface formations in the reservoir, the fracture zone having a fracture half-length $x_f$, and wherein the step of determining an inflow performance relationship for the gas fractured well includes the steps of:

(a) determining the well bore flowing pseudo-pressure $m(P_{wf}(t))$ according to the following relationship, $$m(P_{wf}(t)) = m(P_i(t)) - \frac{m_{wD}(t_{Dxf}, F_{cD}) \cdot 1424 \cdot q_g(t) \cdot T}{kh},$$

where $m(P_i(t))$ is the initial reservoir pseudo-pressure, $m_{wD}(t_{Dxf}, F_{cD})$ is the dimensionless pseudo-pressure drop obtained from the type curves of the reservoir at the dimensionless time $t_{Dxf}$ given by the expression, $$t_{Dxf} = \frac{0.000264 \cdot kt}{\phi(\mu C_t)_i x_f^2}$$

where t is time, $\phi$ is the formation porosity, $C_t$ is the system total compressibility, $\mu$ is the viscosity of the gas, $q_g(t)$ is the gas production rate as a function of time, T is the reservoir temperature, k is the reservoir permeability, and h is the height of the fracture zone in the reservoir formations;

(b) determining the average reservoir pseudo-pressure $m(\bar{P}_r(t))$ according to the following relationsip, $$m(\bar{P}_r(t)) = m(P_i(t)) - \frac{\bar{m}_D(t_{Dxf}) \cdot 1424 \cdot q_g(t) \cdot T}{kh},$$

where $\bar{m}_D(t_{Dxf})$ is the dimensionless average pseudo-pressure drop;

(c) determining the maximum flow rate $q_{gmax}(t)$ for the gas according to the following relationship, $$q_{gmax}(t) = (1 - m(P_{wf}(t))/m(\bar{P}_r(t))/q_g(t);$$

and (d) determining the IPR curve of $p_{wf}(t)$ as a function of $q_g(t)$ by solving the following relationship for $m(P_{wf}(t))$, $$m(P_{wf}(t)) = m(\bar{P}_r(t))\,(1 - q_g(t)/q_{gmax}(t)),$$

where $m(\bar{P}_r(t))$ and $q_{gmax}(t)$ are the results of steps (b) and (c) above, and then convering from pseudo-pressure to actual pressure.

* * * * *